US007484868B2

(12) United States Patent
Oyama

(10) Patent No.: US 7,484,868 B2
(45) Date of Patent: Feb. 3, 2009

(54) VEHICLE LIGHT

(75) Inventor: Hiroo Oyama, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 121 days.

(21) Appl. No.: 11/567,881

(22) Filed: Dec. 7, 2006

(65) Prior Publication Data

US 2007/0127255 A1 Jun. 7, 2007

(30) Foreign Application Priority Data

Dec. 7, 2005 (JP) ..... 2005-352881

(51) Int. Cl.
*F21V 7/09* (2006.01)

(52) U.S. Cl. ..... 362/517; 362/514; 362/516; 362/520; 362/297

(58) Field of Classification Search ..... 362/514, 362/516–520, 297, 298, 341, 347
See application file for complete search history.

(56) References Cited

U.S. PATENT DOCUMENTS 6,543,910 B2 * 4/2003 Taniuchi et al. ..... 362/297
6,796,696 B2 * 9/2004 Taniuchi ..... 362/539

FOREIGN PATENT DOCUMENTS

JP 2002313112 10/2002

* cited by examiner

*Primary Examiner*—Bao Q Truong
(74) *Attorney, Agent, or Firm*—Cermak Kenealy Vaidya & Nakajima LLP

(57) ABSTRACT

A vehicle light can be configured to reduce the difference between the cut-off line of the actual light distribution pattern and the cut-off line of the designed light distribution pattern. The vehicle light can include a light source, first reflectors configured to reflect light from the light source, corresponding second reflectors configured to reflect light from the respective first reflectors, and a support member configured to support the light source. The support member and the first reflectors can be separately formed. Furthermore, edge portions configured to form cut-off lines in the light distribution pattern by the second reflectors can be provided in the support member instead of in the first reflectors.

15 Claims, 4 Drawing Sheets

VEHICLE LIGHT

BACKGROUND

This application claims the priority benefit under 35 U.S.C. § 119 of Japanese Patent Application No. 2005-352881 filed on Dec. 7, 2005, which is hereby incorporated in its entirety by reference.

1. Field

The disclosed subject matter relates to a vehicle light such as a vehicle headlight, a vehicle auxiliary light, spot light, traffic light, and the like, having a reflector for reflecting light emitted from a light source and another reflector for reflecting the reflected light in front of the vehicle (e.g., along an light emitting direction of the vehicle light). In particular, the disclosed subject matter relates to a vehicle light which can reduce the difference between the cut-off line of the actual light distribution pattern and the cut-off line of the designed light distribution pattern. Furthermore, the disclosed subject matter relates to a vehicle light in which a reflector for reflecting light emitted from a light source can be processed easily and which can reduce the abovementioned difference between the cut-off line of the actual light distribution pattern and the cut-off line of the designed light distribution pattern.

2. Description of the Related Art

FIG. 1 is a perspective view showing a conventional vehicle light formed as a headlight. In FIG. 1, reference numeral 101 denotes a light source such as a filament coil for a light source, or a high light intensity part of a discharge lamp. Reference numeral 102 denotes a bulb containing the light source 101, and reference numeral 103 denotes a socket hole through which the bulb 102 is mounted. Reference numeral 104 denotes a reflector for reflecting light from the light source 101 in front of the vehicle. The surface of the reflector 104 is formed as a single complex reflecting surface extending in the right and left direction. Another type of reflector for a vehicle headlight includes a conventional multi-reflector (not shown) having a plurality of reflecting surfaces. Before developing such a multi-reflector for a vehicle headlight, a revolved parabolic surface had been mainly adopted as the reflecting surface of a vehicle headlight.

In FIG. 1, reference numeral 105 denotes a cover lens (or a front lens), and reference numeral 106 denotes a grouped lens composed of a plurality of ribbed lenses arranged on the center part of the cover lens 105. The shown conventional vehicle headlight has the grouped lens 106 only on the center part of the cover lens 105, but a vehicle headlight having a grouped lens 106 formed over a cover lens 105 has been conventionally known (not shown). Further, the grouped lens 106 may be separately formed from the cover lens 105 and may be arranged inside the cover lens 105 (not shown).

Reference numeral 107 denotes a metal cover for shielding direct light from the light source 101 that is directed toward the outside to prevent light from becoming glare light which is outside the specifications or regulations for the given lamp. Another conventional vehicle headlight has been known which has another grouped lens instead of such a metal cover 107, for preventing the direct light from the light source 101 from becoming glare light.

In the conventional vehicle headlight shown in FIG. 1, a light loss percentage of typically 10 to 20% typically occurs due to the provision of the grouped lens 106 that includes lens cuts. The main purpose of the lens cut is to produce diffusion light rightward and leftward. When the lens cut is provided to irradiate diffusion light rightward and leftward with an angle of 30° in the front-to-rear direction of the vehicle, light will inevitably attenuate. In addition to this, diffusion light that is spread rightward and leftward with an angle of 30° or greater (for example 40° to 50°) in the front-to-rear direction of the vehicle will not be increased, resulting in a darkened light.

On the other hand, still another type of conventional vehicle headlight has been known, which includes a light source, an elliptic reflector for reflecting light emitted from the light source, and a parabolic reflector for reflecting the light reflected from the elliptic reflector in front of the vehicle. Such a vehicle headlight is disclosed in Japanese Patent Laid-Open Publication No. 2002-313112, the disclosure of which is hereby incorporated in its entirety by reference.

This conventional vehicle headlight has elliptic reflectors on the respective right and left sides of the light source. They are disposed such that both the first foci thereof are located at the position of the light source. Furthermore, parabolic reflectors are disposed on the respective right and left sides of the light source to reflect light reflected from the respective right and left elliptic reflectors in front of the vehicle. In this instance, the focus of the left parabolic reflector is disposed in the vicinity of the position of the second focus of the right elliptic reflector while the focus of the right parabolic reflector is disposed in the vicinity of the position of the second focus of the left elliptic reflector. Furthermore, an opening is formed in the left elliptic reflector in order to guide light reflected by the right elliptic reflector towards the left parabolic reflector, and vice versa.

Furthermore, in this vehicle headlight, the edge portions of the openings in the right and left elliptic reflectors are designed such that cut-off lines are formed in the light distribution patterns irradiated in front of the vehicle by the respective right and left parabolic reflectors.

In a vehicle headlight as disclosed in Japanese Patent Laid-Open Publication No. 2002-313112, the light source is covered with the right and left elliptic reflectors. The portion for supporting the light source and the right and left elliptic reflectors are typically formed as separate members. This facilitates the processing of the right and left elliptic reflectors.

In such a configuration where the support portion and the right and left elliptic reflectors are separately formed, the cut-off line of the light distribution pattern formed by the edge portion of the opening of the right elliptic reflector may be deviated from the cut-off line of the designed light distribution pattern. This is true in the case of the left elliptic reflector. It is conceivable that this may be caused by manufacturing errors of the support member and the elliptic reflectors, and assembly errors of the elliptic reflectors with respect to the support member. The presently disclosed subject matter results from earnest research into a technique for reducing the effect of the errors that appear due to the actual cut-off line being shifted from the designed cut-off line.

In view of the abovementioned and other conventional problems, it has been found that the edge portion, which forms the cut-off line of the light distribution pattern, can be removed from the right and left elliptic reflectors, and instead can be provided in a support portion for supporting a light source. This configuration can reduce the difference between the cut-off line of the actual light distribution pattern and the cut-off line of the designed light distribution pattern.

SUMMARY

Therefore, according to an aspect of the disclosed subject matter, a vehicle light can be configured to reduce the difference between the cut-off line of the actual light distribution pattern and the cut-off line of the designed light distribution pattern.

In addition, another aspect of the disclosed subject matter is to provide a vehicle light which can reduce the difference between the cut-off line of the actual light distribution pattern and the cut-off line of the designed light distribution pattern as well as facilitate the processing of the reflector for reflecting light emitted from the light source.

One aspect of the disclosed subject matter includes a vehicle light including: a light source; a first reflector configured to reflect light emitted from the light source; a second reflector configured to reflect light reflected by the first reflector in front of the vehicle; and a support member configured to support the light source, the support member being separately formed from the first reflector. In this configuration, an edge portion configured to form a cut-off line in a light distribution pattern that is to be irradiated in front of the vehicle by the second reflector is provided in the support member.

In the abovementioned vehicle light, the support member for supporting the light source can be formed as a separate member with respect to the first reflector which can reflect light emitted from the light source towards the second reflector. As compared to the case where they are integrally formed as a single unit, the reflecting surface of the first reflector can be easily processed.

In addition, the edge portion for forming the cut-off line of the light distribution pattern irradiated by the second reflector in front of the vehicle is not formed in the first reflector, but formed in the support member. In this case, as compared to the case where the edge portion is formed in the first reflector, the above configuration can reduce the difference between the cut-off line of the actual light distribution pattern and the cut-off line of the designed light distribution pattern, the difference being caused due to manufacturing errors and/or assembly errors of the support member and the first reflector.

In an exemplary embodiment, the support member and the second reflector can be formed as a single unit. As compared with the case where the support member and the second reflector are separately formed, it is possible to reduce the difference between the cut-off line of the actual light distribution pattern and the cut-off line of the designed light distribution pattern.

In another aspect of the disclosed subject matter, the first reflector is composed of a first center-side reflector (which is disposed on the center side of the vehicle and nearer than the light source is to the center of the vehicle to which the light is mounted) and a first side-face reflector (which is disposed on a side-face side of the vehicle and nearer than the light source is to the side-face side of the vehicle to which the light is mounted). The first center-side reflector can have a first focus in the vicinity at which the light source is disposed. Also, the first side-face reflector has a first focus in the vicinity at which the light source is disposed. Furthermore, the second reflector can be composed of a second center-side reflector (which is disposed on the center side of the vehicle and nearer the center of the vehicle than is the light source) and a second side-face reflector (which is disposed on the side-face side of the vehicle and nearer the side-face side than is the light source). In this instance, the average distance from the second focus of the first center-side reflector to the reflecting surface of the second side-face reflector can be approximately 1.5 to two times as long as the average distance from the second focus of the first side-face reflector to the reflecting surface of the second center-side reflector.

In an alternative exemplary embodiment, the area of the reflecting surface of the second side-face reflector can be approximately two to three times as large as the area of the reflecting surface of the second center-side reflector. In other words, the reflecting surface of the second side-face reflector is arranged closer to the rear side of the vehicle than the light source, and the reflecting surface of the second center-side reflector is arranged closer to the fore side of the vehicle than is the light source. In this configuration, the reflecting surface of the second side-face reflector is made larger and deeper than the reflecting surface of the second center-side reflector.

In another exemplary embodiment, the light converging power of the second side-face reflector can be larger than that of the second center-side reflector. In other words, the light distribution pattern can be formed by converging light by means of the side-face reflector. As compared with the case where the light distribution pattern is formed by the center-side reflector, it is possible to efficiently form a light distribution pattern with high distance visibility as well as with a large intensity of converged light. According to an alternative definition, the degree of diffusion of the reflecting surface of the second center-side reflector can be larger than that of the second side-face reflector. Namely, the second center-side reflector can diffuse light horizontally for illumination. As compared with the case where the side-face reflector disposed on the deeper side diffuses the light for illumination, it is possible to make the diffusion angle of light larger.

In another exemplary embodiment, the light source is arranged so that the center axis of the light source is approximately parallel to a horizontally cross-sectional curve of the first center-side reflector. In addition, the light emitted from the light source is allowed to pass through the first through hole formed in the first center-side reflector to be irradiated in front of the vehicle.

As compared to the case where the light emitted from the light source is irradiated in front of the vehicle by one or more reflections, it is possible to improve the light utilization efficiency from the light source with high illuminance in this case.

In another exemplary embodiment, a reflecting surface for reflecting light emitted from the light source is formed in the support member. In addition to this, a second through hole is disposed between the first center-side and side-face reflectors. The second through hole can allow light reflected from the reflecting surface of the support member to be irradiated in front of the vehicle. Namely, the light emitted from the light source towards the support member is reflected by the reflecting surface of the support member, and then passes through the second through hole between the first center-side and side-face reflectors, thereby being irradiated in front of the vehicle. This improves the light utilization efficiency of light from the light source with high illuminance.

In the abovementioned vehicle light, a diffusion plate can be provided, which has a predetermined transparency for horizontally diffusing the light which has passed through the second through hole. Specifically, the diffusion plate can be configured to extend from a position near the second through hole on the side-face side of the vehicle to the fore side of the vehicle and can be curved toward the center side of the vehicle.

In another exemplary embodiment, part of light which has passed through the second through hole is allowed to pass through the diffusion plate to generate diffracted light which is in turn allowed to be horizontally diffused to be irradiated either in front of the vehicle or sideways or generally in a light emitting direction. Furthermore, another part of light which has passed through the second through hole can be reflected by the diffusion plate to be irradiated in front of the vehicle. In other words, not only the light that is diffracted after passing through the diffusion plate is irradiated in front of the vehicle, but the light that is reflected by the diffusion plate can also be irradiated in front of the vehicle effectively. This can improve the light utilization efficiency.

In another exemplary embodiment, the diffusion plate and the first side-face reflector are formed as a single unit. This can reduce the parts number and also suppress the manufacturing cost.

BRIEF DESCRIPTION OF THE DRAWINGS

These and other characteristics, features, and advantages of the disclosed subject matter will become clear from the following description with reference to the accompanying drawings, wherein.

DETAILED DESCRIPTION OF EXEMPLARY EMBODIMENTS

The term "left (or left side)" used herein refers to the left side of the vehicle when seen from a front passenger side of the vehicle, and the term "right (or right side)" refers to the right side of the vehicle when seen from a front passenger side of the vehicle.

It should be appreciated that the disclosed subject matter can be applied to a vehicle light such as a vehicle headlight, a vehicle auxiliary light, a spot light, a traffic light, and the like. Hereinafter, a headlight is exemplified in order to describe the disclosed subject matter.

Figure 2:
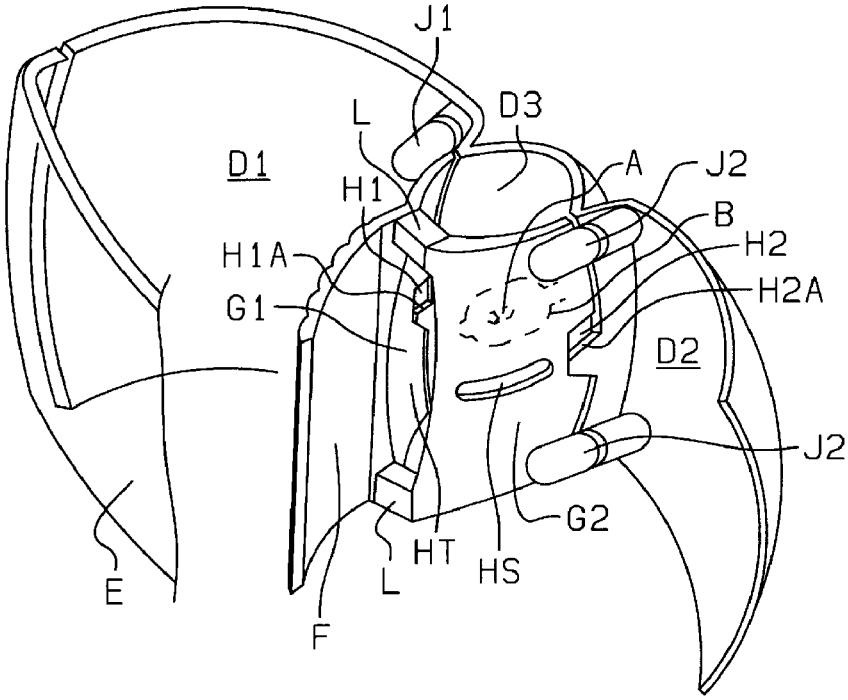
FIG. 2 is a perspective view of an embodiment of a vehicle headlight made in accordance with principles of the disclosed subject matter.
Figure 3:
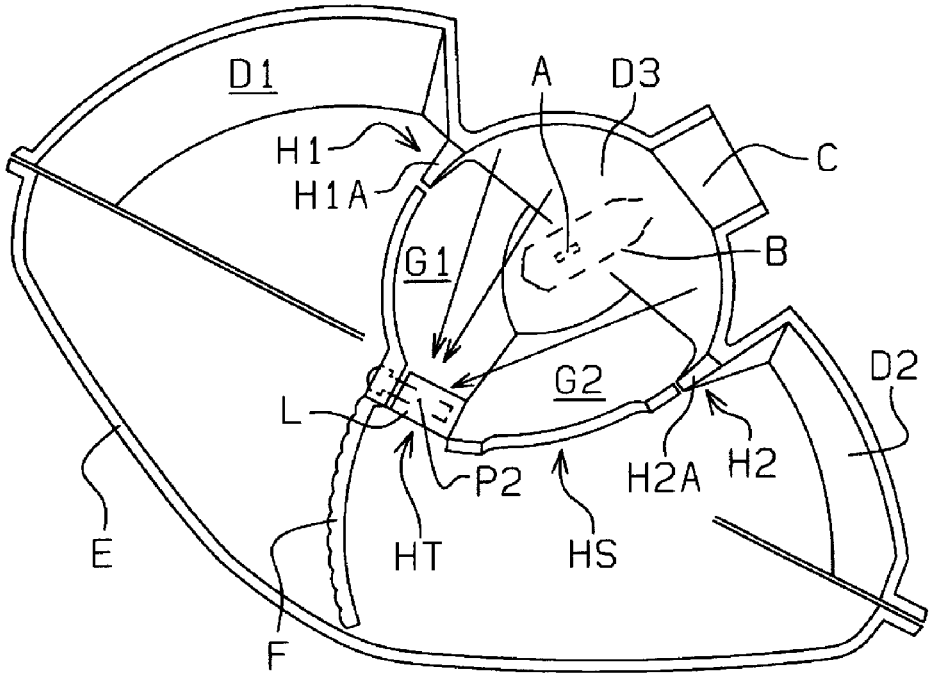
FIG. 3 is a horizontal cross sectional view of the vehicle headlight of FIG. 2.

An exemplary embodiment of the disclosed subject matter will be described in detail with reference to FIG. 2, which is a perspective view of an exemplary embodiment of a vehicle headlight made in accordance with principles of the disclosed subject matter. In particular, FIG. 2 is a perspective view of the vehicle headlight for a right-side traffic system, seen from above and front. FIG. 3 is a horizontal cross sectional view of the vehicle headlight of FIG. 2. In particular, the lower side in FIGS. 2 and 3 corresponds to the front side of a vehicle and the upper side thereof corresponds to the rear side of the vehicle. In addition, the left side thereof corresponds to the right side (right side surface) of the vehicle and the right side thereof corresponds to the left side (center side) of the vehicle. The vehicle headlight according to the first exemplary embodiment shown in FIGS. 2 and 3 is designed to extend from the front surface to the right side face of the vehicle.

In FIGS. 2 and 3, symbol A denotes a light source. Symbol B denotes a bulb incorporating the light source A. In the first exemplary embodiment, the main optical axis (center axis) of the light source A is directed to the front right side of the vehicle (lower left side in FIG. 3) such that the main optical axis (center axis) of the light source A forms 45°±15° with respect to the front-to-rear direction (up and down direction in FIG. 3) of the vehicle.

Symbol C denotes an attachment hole for attaching a socket for a light source, and symbol D3 denotes a reflector configured to reflect light emitted from the light source A. In the first exemplary embodiment, the reflector D3 can serve as a reflecting surface as well as a supporting member for supporting the light source A. Symbol D1 denotes a reflector configured to reflect the converged light to the front of the vehicle (lower side in FIG. 3). The reflector D1 is arranged on the right side of the light source A (right side face of the vehicle). Symbol D2 denotes a reflector configured to reflect light with a smaller converging degree than the irradiation light from the reflector D1 to the front of the vehicle (lower side in FIG. 3). The reflector D2 is arranged on the left side of the light source A (center side of the vehicle). In the first exemplary embodiment, the reflectors D1, D2, and D3 are formed as a single member.

Symbol G1 denotes an elliptic reflector configured to reflect the light emitted from the light source A towards reflector D2. Symbol G2 denotes an elliptic reflector configured to reflect the light emitted from the light source A towards the reflector D1. In the first exemplary embodiment, the reflector G1 is arranged so that the light source A is located at or in the vicinity of the first focus of the elliptic reflector G1. The reflector G2 is arranged so that the light source A is located at or in the vicinity of the first focus of the elliptic reflector G2. In the first exemplary embodiment, the reflectors D1, D2, and D3, the reflector G1, and the reflector G2 are formed as separate members. The reflectors D1, D2, and D3 and the reflector G1 can be connected with each other by screws or other attachment structures, adhesive materials, weld methods, etch. The reflectors D1, D2, and D3 and the reflector G2 as shown are connected with each other by screws. The reflector G1 and the reflector G2 can also be connected with each other by screws or other attachment structures, adhesive materials, weld methods, etc.

Symbol H1 denotes a hole formed in the vicinity of the second focus of the elliptic reflector G2 and in the boundary portion between the reflectors D3 and G1. The hole H1 is configured so as to allow the light reflected from the elliptic reflector G2 to reach the reflector D1. Symbol H2 denotes a hole formed in the vicinity of the second focus of the elliptic reflector G1 and in the boundary portion between the reflectors D3 and G2. The hole H2 is configured so as to allow light that is reflected from the elliptic reflector G1 to reach the reflector D2. In the first exemplary embodiment, the hole H1 has a lower edge H1A for forming the cut-off line in the light distribution pattern formed in front of the vehicle by the reflector D1. In addition, the hole H2 has a lower edge H2A for forming the cut-off line in the light distribution pattern formed in front of the vehicle by the reflector D2. Furthermore, the lower edge H1A of the hole H1 is provided in the reflector D3 (and not in the reflector G1). The lower edge H2A of the hole H2 is provided in the reflector D3 (and not in the reflector G2).

In the first exemplary embodiment, the reflector D1 is composed of a complex elliptic surface similar to a revolved parabolic surface, and converges light that has passed through the hole H1 and reflects the light toward the front side of the vehicle (lower side in FIG. 3). The reflector D2 can also be composed of a complex elliptic surface similar to a revolved parabolic surface, and can be configured to converge the light passing through the hole H2 and reflect the light toward the front side of the vehicle (lower side in FIG. 3).

Furthermore, symbol J1 denotes a boss portion serving as a screw accommodating section for accommodating screws connecting the reflectors D1, D2, and D3 to the reflector G1. Symbol J2 denotes another boss portion serving as a screw accommodating section for accommodating screws connecting the reflectors D1, D2, and D3 to the reflector G2. Symbol L denotes screw accommodating section for accommodating screws connecting the reflector G1 to the reflector G2. Of course, the screw accommodating sections can alternatively be configured as other attachment structure accommodating sections, adhesive attachment structure accommodating sections, etc.

Symbol HS denotes a first through hole formed in the reflector G2 such that it is substantially parallel to the light source A. The hole HS is, for example, a horizontally elongated hole. In the first exemplary embodiment, as shown in FIG. 3, the light source A and the reflector G2 are arranged such that the center axis of the light source A and the horizontal cross-sectional curve of the reflector G2 are substantially parallel to each other. Accordingly, part of the light emitted from the light source A is allowed to pass through the first through hole HS without being reflected so as to be irradiated in front of the vehicle (lower side in FIG. 3). In particular, in the first exemplary embodiment, light horizontally emitted from the light source A and light that is emitted slantways and downward from the light source A passes through the first through hole HS. Furthermore, the light emitted upward from the light source A is not allowed to pass through the first through hole HS.

Symbol HT denotes a second through hole located at the boundary portion between the reflector G1 and the reflector G2 and configured so as to allow reflected light from the reflector D3 to pass therethrough. The second through hole can be, for example, a longitudinal hole. In the first exemplary embodiment, as shown in FIG. 3, the horizontal cross section of the reflecting surface of the reflector D3 is formed as an elliptic arc. The reflector D3 is configured so that the light source A is located at or in the vicinity of the first focus of the elliptic arc and the second through hole HT is located at the second focus P2 thereof. Within the horizontal plane, the light reflected from the reflector D3 is converged on the second focus P2, and then diffused. Furthermore, the reflecting surface of the reflector D3 has an elliptic arc in a vertical cross section that is similar to a parabola (not shown). The reflector D3 is configured so that the light source A is located at or in the vicinity of the first focus of the elliptic arc and the second focus thereof is located 10 m to 40 m away from the light source A in the forward direction (the lower side in FIG. 3). Namely, the light reflected by the reflector D3 is converged 10 m to 40 m away in front of the light source (lower side in FIG. 3) within the vertical plane.

Symbol E denotes a cover lens or a front lens.

Symbol F denotes a diffusion plate. The diffusion plate F may be made of, for example, a transparent corrugated plate having a given light transmittance. The diffusion plate F can diffuse the light passing through the second through hole HT in right and left directions. Alternatively, the diffusion plate F may be made of a translucent plate, or a plate member without lens cut portions formed on the surface. It should be appreciated that in the first exemplary embodiment the diffusion plate F and the reflector G1 are integrally formed as a single part. In particular, the diffusion plate F and the reflector G1 may be formed of, for example, a transparent resin material, and the inside surface of the reflector G1 can be subjected to aluminum vapor deposition treatment to complete the elliptic reflector G1. In this manner, the reflector G1 can be made of a transparent resin material and can have a vapor deposited aluminum applied thereto, and the resultant reflector G1, when viewed from outside, is beautiful and neat in appearance due to the thickness of the transparent resin material portion of the reflector G1.

The diffusion plate F in the first exemplary embodiment can be configured to extend from the right side of the second through hole HT (left side in FIGS. 2 and 3) to the front side of the vehicle (lower side in FIG. 3). In addition to this, the end portion of the diffusion plate F can be curved so that it is directed toward the center of the vehicle (right side in FIGS. 2 and 3). As a result, at least part of the light passing through the second through hole HT is irradiated in front of the vehicle (lower side in FIG. 3) without being incident on the diffusion plate F. Furthermore, at least another part of the light passing through the second through hole HT can be incident on the incident surface of the diffusion plate F (right side surface in FIG. 3) and emitted through the emitting surface (left side surface in FIG. 3). At that time, the light is refracted to be diffused and irradiated toward the front right side (left lower side in FIG. 3) and right side (left side in FIG. 3) of the vehicle. The remains of the light passing through the second through hole HT is reflected by the incident surface or the emitting surface of the diffusion plate F so as to be irradiated toward the front left side (right lower side in FIG. 3) of the vehicle.

Figure 4:
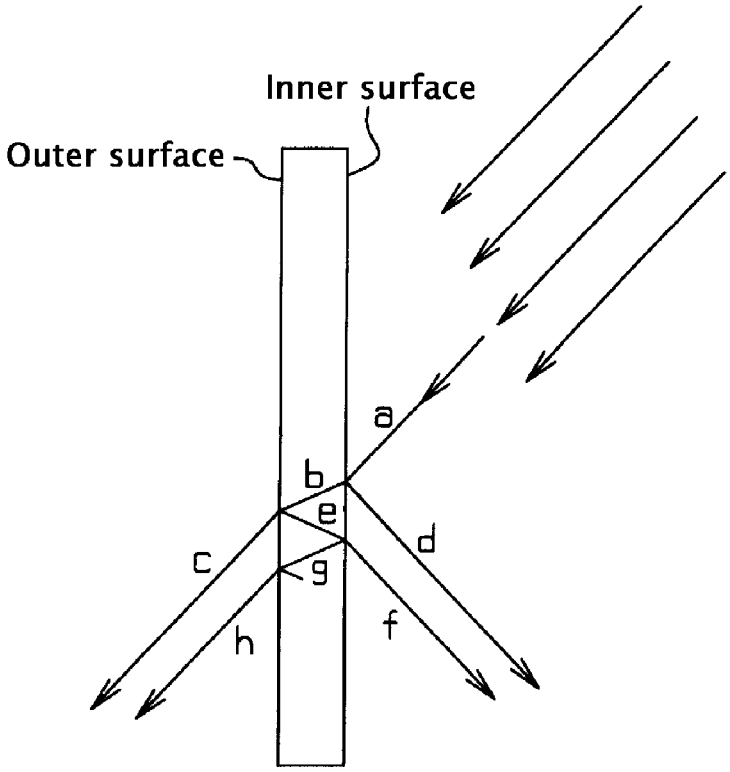
FIG. 4 is a diagram illustrating function and effects of the diffusion plate F.
Figure 5:
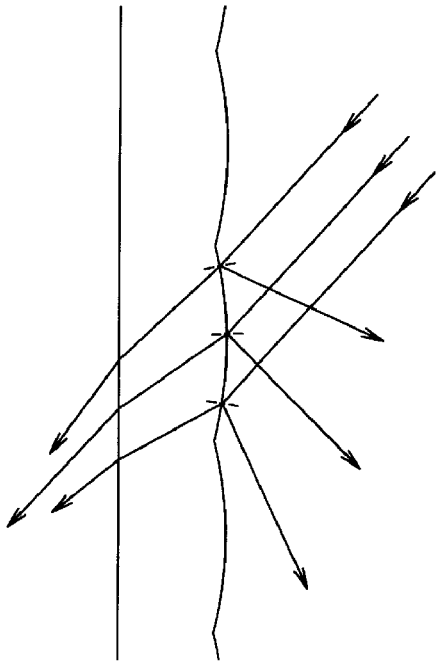
FIG. 5 is another diagram illustrating function and effects of the diffusion plate F.
Figure 6:
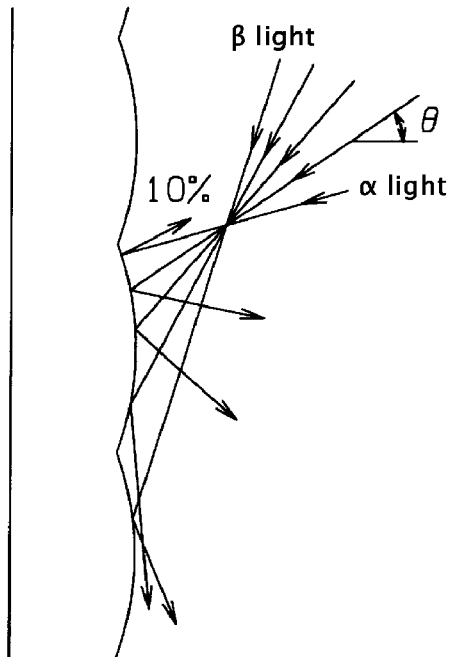
FIG. 6 is still another diagram illustrating function and effects of the diffusion plate F.
Figure 7:
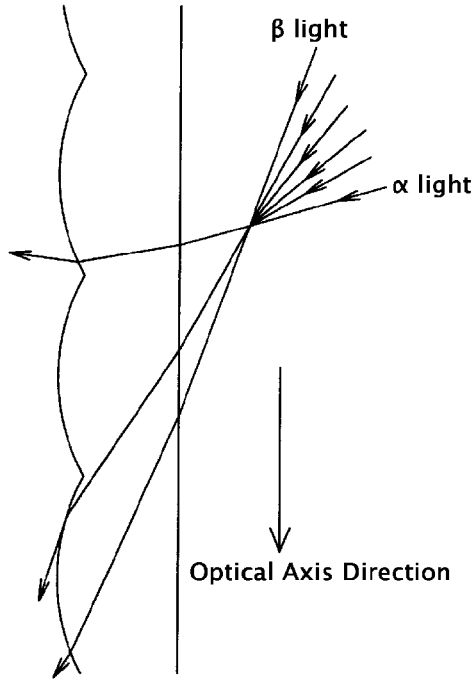
FIG. 7 is a further diagram illustrating function and effects of the diffusion plate F.

FIGS. 4 to 7 are exemplary drawings showing function and effects of the diffusion plate F. In particular, FIG. 4 shows parallel light being incident on a transparent parallel plate, light being reflected by the transparent parallel plate, and light passing through the transparent parallel plate. FIG. 5 shows a transparent parallel plate with small (thin) convex portions formed in the inner surface (incident surface) of the transparent parallel plate shown in FIG. 4, serving as the diffusion plate. In this figure, parallel light is allowed to be incident on the diffusion plate. FIG. 6 shows a state wherein diffused light is allowed to be incident on the diffusion plate shown in FIG. 5. FIG. 7 shows a transparent parallel plate with small (thin) convex portions formed in the outer surface (emitting surface) of the transparent parallel plate, serving as the diffusion plate. In this figure, diffused light is allowed to be incident on the diffusion plate.

As shown in FIG. 4, approximately 90% of the incident light a enters the transparent parallel plate, while being refracted, so as to become light b, and approximately 10% of the incident light a is reflected by the inner surface (incident surface) so as to become inner reflected light d. The light b reaches the outer surface (emitting surface) to be divided into transmitted light c and reflected light e. The reflected light e reaches the inner surface (incident surface) to be divided into light f and reflected light g. Then, part of the reflected light g that has reached the outer surface (emitting surface) passes through the outer surface to become transmitted light h.

The transparent parallel plate shown in FIG. 4 is a completely transparent body. If the theoretical absorbance is substantially zero and the light a is 100%, the transparent light c is approximately 81% of the light a, the reflected light d is approximately 10% of the light a, the light f is approximately 8% of the light a, and the transparent light h is equal to, or less than, 1% of the light a. In other words, the total amount of light emitted from both the surfaces of the transparent parallel plate (c+d+f+h) is equal to, or more than, 99% of the incident light. Accordingly, if the surface reflectance is different value, when the absorbance of the material of the transparent parallel plate is assumed to be substantially zero, the total amount of light obtained can be 99% or more of the incident light.

As shown in FIG. 5, the surface of the convex portion of the incident surface of the diffusion plate (right side in FIG. 5) is configured to be similar to a convex mirror, and the resulting diffusion plate can generate diffusion light reflected by the incident surface of the convex portion of the diffusion plate. The light incident on the incident surface is converged once due to the convex like-lens function of the convex portion and travels through the diffusion plate, and then is refracted when being emitted from the outer surface (emitting surface) of the diffusion plate to the outside. When the surface is composed of the convex portion which is slightly warped, the total amount of light that can be obtained is 99% or more of the incident light, which is similar to the case shown in FIG. 4. Although not shown in the drawings, when the surface is composed of concave portions instead of convex portions, the light which is reflected by the concave surface is once converged and then diffused to become diffusion light with the total amount of obtained light being 99% or more, which is similar to the case shown in FIG. 5. the light having passed through the diffusion plate and been emitted from the emitting surface of the diffusion plate. Thus, the light received directly from the light source and/or the light reflected by the reflector is first incident on the incident surface of the diffusion plate. At this time, the light is converged by the convex lens-like function of the surface shape of the diffusion plate. Then, the light passes through the diffusion plate and is emitted from the emitting surface of the diffusion plate. At this time, the light is refracted by the interface of the emitting surface and outside space (air). This means both the light reflected by the incident surface and the light passing through the incident surface are diffused.

In the case shown in FIG. 6, consider that the inner surface (incident surface) of the transparent parallel plate has shallow (thin) convex portions. When diffused light is allowed to be incident on the diffusion plate, β light shown in FIG. 6 is reflected in a right lower direction. On the other hand, α light may be reflected in a right upper direction in some cases. In this case, loss of light occurs and the total amount of light may be decreased.

As shown in FIG. 7, when the outer surface (emitting surface) of the transparent parallel plate has shallow (thin) convex portions, part of the diffused light that is incident on the diffusion plate may not be returned toward the right upper direction in FIG. 7. On the contrary, the light that passes through the diffusion plate may travel forward to the left upper side as shown in FIG. 7. In the case where the vehicle headlight of the first exemplary embodiment is arranged so as to extend from the front face to the right side of the vehicle body as shown in FIGS. 2 and 3, if the light that has passed through the diffusion plate F travels forward to the left upper side as shown in FIG. 3, the light is irradiated in the right direction and may be utilized effectively to compensate the light for use in driving. In other words, the light traveling toward the left upper side in FIG. 3 may not decrease.

In the first exemplary embodiment, as shown in FIGS. 2 and 3, the end portion of the diffusion plate F is curved so that it is directed toward the center of the vehicle (right side in FIGS. 2 and 3) and the light that passes through the second through hole HT can be captured with ease. As a result, the diffused light which is not incident on the diffusion plate F is mixed with the diffused light reflected by the diffusion plate F, thereby providing widely spread diffusion light.

Figure 1:
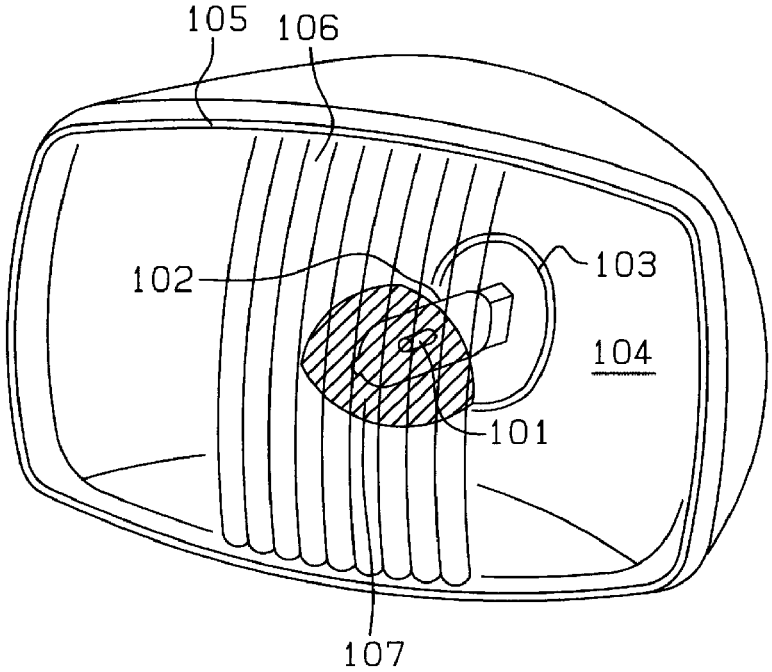
Fig. 1 Conventional Art
FIG. 1 is a perspective view of a conventional vehicle headlight.

In the first exemplary embodiment as shown in FIGS. 2 and 3, not only the light passing through the diffusion plate F but also the light reflected by the diffusion plate F are effectively irradiated toward the front of the vehicle (lower side in FIG. 3) and the side thereof (left side in FIG. 3). On the other hand, the conventional vehicle headlight as shown in FIG. 1 irradiates light that passes through the grouped lens 106 in front of the vehicle, but part of the light reflected by the grouped lens 106 may be reflected back toward the light source 101, and the reflected-back light may not be effectively utilized for driving. In a concrete example, light loss of approximately 15% may occur. Accordingly, the vehicle headlight according to the first exemplary embodiment can increase the effective amount of light by 10% or more as compared to the conventional vehicle headlight shown in FIG. 1.

In the first exemplary embodiment, the headlight includes the diffusion plate F as shown in FIGS. 2 and 3 instead of the metal cover 107 of the conventional vehicle headlight. In the conventional vehicle headlight as shown in FIG. 1, the metal cover 107 shields part of the direct light from the light source 101 in order to prevent the generation of glare light that is directed toward an opposite vehicle. As a result, part of the direct light from the light source 101 cannot be utilized, thereby decreasing the light utilization efficiency.

On the other hand, the vehicle headlight according to the first exemplary embodiment as shown in FIGS. 2 and 3 can emit diffused light in a wide range in the right and left directions, with the light from the light source A being diffused by the diffusion plate F so as to prevent the generation of glare light toward the opposite vehicle. As a result, the light utilization efficiency from the light source A can be increased and light diffused by the diffusion plate F can be irradiated in a wider range, toward the side of the vehicle (left side, and left front and right front sides in FIG. 3).

In addition, in the first exemplary embodiment, the light, which is emitted from the light source A and reflected by the elliptic reflector G2 as shown in FIGS. 2 and 3, is converged on the second focus of the elliptic reflector G2 after passing through the hole H1, thereby forming an image of the light source A. Furthermore, the outer periphery of the image of the light source A formed in the vicinity of the second focus of the reflector G2 is cut by the hole H1. In this instance, the lower edge H1A of the hole H1 is formed into a shape of, for example, a broken line or a Z-shaped broken line, and accordingly, the outer periphery of the image of light source A is partly cut. In accordance with the cut shape, the light distribution pattern is formed with a cut-off line via the reflector D1.

Consider a case where the reflector G1, which is separately formed from the reflector D3, has an edge portion for forming the cut-off line in the light distribution pattern (instead of the edge being formed in the lower edge H1A of the hole H1). In this case, the positional relationship between the light source A and the second focus of the elliptic reflector G2 may vary due to manufacturing error in the reflectors D3 and G1 and/or assembly errors of the reflector G1 to the reflector D3. The variation of the positional relationship may possibly increase the difference between the cut-off line of the actual light distribution pattern and the cut-off line of the designed light distribution pattern. To cope with this, in the first exemplary embodiment the lower edge H1A of the hole H1 that provides the cut-off line in the light distribution pattern is provided not in the reflector G1, but in the reflector D3. As a result, the manufacturing stability may be improved by decreasing the shift of the actual cut-off line due to the manufacturing and assembly errors as described above.

In the same manner, in the first exemplary embodiment, the light, which is emitted from the light source A and reflected by the elliptic reflector G1 as shown in FIGS. 2 and 3, is converged on the second focus of the elliptic reflector G1 after passing through the hole H2, thereby forming an image of the light source A. Furthermore, the outer periphery of the image of the light source A formed in the vicinity of the second focus of the reflector G1 is cut by the hole H2. In this instance, the lower edge H2A of the hole H2 is formed into a shape of, for example, a broken line or a Z-shaped broken line, and accordingly, the outer periphery of the image of light source A is partly cut. In accordance with the cut shape, the light distribution pattern is formed with cut-off line via the reflector D2.

Consider a case where the reflector G2, which is separately formed from the reflector D3, has an edge portion for forming the cut-off line in the light distribution pattern (instead of forming the edge portion in the lower edge H2A of the hole H2). In this case, the positional relationship between the light source A and the second focus of the elliptic reflector G1 may vary due to manufacturing errors associated with the reflectors D3 and G2 and/or assembly errors that occur during connection of the reflector G2 to the reflector D3. The variation of the positional relationship may possibly increase the difference between the cut-off line of the actual light distribution pattern and the cut-off line of the designed light distribution pattern. To cope with this, in the first exemplary embodiment the lower edge H2A of the hole H2 that is configured to provide the cut-off line in the light distribution pattern is provided in the reflector D3 (and not in the reflector G2). As a result, manufacturing stability may be improved by reducing the difference between the cut-off line of the actual light distribution pattern and the cut-off line of the designed light distribution pattern due to manufacturing and assembly errors as described above.

The vehicle headlight in accordance with the first exemplary embodiment has right-left asymmetry. In particular, as shown in FIGS. 2 and 3, the reflecting surface of the reflector D1 on the right side of the vehicle (left side in FIGS. 2 and 3) is made larger and deeper than that of the reflector D2 on the center side of the vehicle (right side in FIGS. 2 and 3). In other words, in an exemplary embodiment the average distance between the second focus of the elliptic reflector G2 and the reflecting surface of the reflector D1 is approximately 1.5 to 2 times as long as the average distance between the second focus of the elliptic reflector G1 and the reflecting surface of the reflector D2. Alternatively, the reflecting surfaces of the reflectors D1 and D2 can be formed such that the area of the reflecting surface of the reflector D1 is approximately 2 to 3 times as large as the area of the reflecting surface of the reflector D2. As a result, the reflector D1 having a relatively large area can form a spot light distribution pattern due to convergence, and at the same time the reflector D2 having a relatively small area can form a diffused large light distribution pattern (diffused light area).

In the first exemplary embodiment, as shown in FIG. 3, the horizontal cross-sectional curve of the reflecting surface of the reflector G2 can be substantially parallel to the main optical axis of the light source A in order to deliver a larger amount of light from the light source A to the reflector D1. In other words, the light emitted from the light source A can be captured by the reflector G2 to a greater degree than by the reflector G1.

In accordance with this configuration, the vehicle headlight in the first exemplary embodiment can irradiate light in the right side and front side of the vehicle with light having a wider range diffused by the diffusion plate F. At the same time, the light irradiated in front of the vehicle can be strengthened by the reflector D1 to improve the distance visibility.

In the exemplary embodiment as described above, the first through hole HS can be provided in order to irradiate direct light from the light source A to the front of the vehicle (lower side in FIGS. 2 and 3) without reflection. In comparison with the case where such a through hole is not formed and light reflected by the elliptic reflector G2 is partly cut by the hole H1 and then irradiated in front of the vehicle by the reflector D1, light loss due to plural reflections may be suppressed and the light utilization efficiency can be improved.

In the above-described exemplary embodiment, the main optical axis (center axis) of the light source A is directed to the right front side of the vehicle (left lower side in FIG. 3). In this case, the side face of the light source A (cylindrical surface) can be seen via the first through hole HS from the front side of the vehicle (lower side in FIGS. 2 and 3). In particular, as shown in FIG. 3, the light source A, the first through hole HS, and the diffusion plate F can be configured so as not to expose the end portion of the diffusion plate F to the light which is emitted from the light source A and passes through the first through hole HS. In addition, the vertical dimension of the first through hole HS can be set so that downward light from the light source A with an angle in a range between approximately 0° and 12° is irradiated through the first through hole HS in front of the vehicle (lower side in FIGS. 2 and 3).

In the exemplary embodiment as described above, the reflector D3 serving as a support member for supporting the light source A is separately formed from the reflectors G1 and G2. In this case, the processing of the reflecting surfaces of the reflectors D3, G1, and G2 can be facilitated in comparison with the case where they are integrally formed.

For example, the lower edge H1A of the hole H1 serves as an edge portion for forming the cut-off line in the light distribution pattern in front of the vehicle (lower side in FIGS. 2 and 3) by the reflector D1, and the edge H1A is not formed in the reflector G1, but in the reflector D3 serving as a support member. In the same manner, the lower edge H2A of the hole H2 serves as an edge portion for forming the cut-off line in the light distribution pattern in front of the vehicle by the reflector D2, and the edge H2A is not formed in the reflector G2, but in the reflector D3.

In comparison with the case where the respective lower edges H1A and H2A are formed in the reflectors G1 and G2, the headlight in accordance with the above described exemplary embodiment can reduce the difference between the cut-off line of the actual light distribution pattern and the cut-off line of the designed light distribution pattern due to manufacturing error associated with the reflectors D3, G1 and G2 and assembly errors when assembling the reflectors G1 and G2 with the reflector D3. As a result, the vehicle headlight can be stably manufactured.

In the exemplary embodiment as described above, the reflector D3 with the lower edges H1A and H2A of the holes H1 and H2 is formed with the reflectors D1 and D2 as a single unit. In comparison with the case where they are separately formed, the difference between the cut-off line of the actual light distribution pattern and the cut-off line of the designed light distribution pattern can be reduced. As another exemplary embodiment, the vehicle headlight include reflectors D1, D2, and D3 formed as separate members.

As described above, the average distance between the second focus of the elliptic reflector G2 and the reflecting surface of the reflector D1 can be approximately 1.5 to 2 times as long as the average distance between the second focus of the elliptic reflector G1 and the reflecting surface of the reflector D2. Alternatively, the area of the reflecting surface of the reflector D1 can be approximately 2 to 3 times as large as the area of the reflecting surface of the reflector D2. Namely, the reflecting surface of the reflector D1 can be larger and deeper than that of the reflector D2. In this way, the converging ability of the reflector D1 is greater than that of the reflector D3. Accordingly, the light distribution pattern is formed to a greater extent by the reflector D1. In the exemplary embodiment configured as described above, the light distribution pattern can be efficiently formed with a high light convergence degree and with high distance visibility in comparison with the case where the light distribution pattern is formed mainly by the reflector D2. The resulting light distribution pattern can also be formed in greater accordance with the intended design in comparison with the case where the reflecting surfaces of the reflectors D1 and D2 each have the same area.

In other words, the diffusion degree associated with the reflector D2 is greater than that of the reflector D1. This can provide light diffused in the right and left directions by the reflector D2. This means that the reflector D2 can provide diffused light with a wider diffusion angle than the reflector D1 does, the reflector D1 being located deeper from the front of the vehicle.

In the exemplary embodiment shown in FIG. 3, the main optical axis of the light source A is made parallel to the horizontal cross-sectional curve of the reflecting surface of the reflector G2 in order that the light emitted from the light source A is allowed to pass through the first through hole HS formed in the reflector G2 and can be irradiated in front of the vehicle (lower side in FIG. 3). This can improve the light utilization efficiency of the light source A in comparison with the case where the light from the light source A is irradiated after plural reflections, thereby increasing the intensity of the irradiated light.

In the above-described exemplary embodiment, the reflector G2 has a first through hole HS. However, the disclosed subject matter is not limited thereto. In another exemplary embodiment, the reflector G2 may not have any through hole corresponding to the first through hole.

In the exemplary embodiment as shown in FIGS. 2 and 3, the reflecting surface for reflecting the light emitted from the light source A is formed in the reflector D3 which also serves as a support member. In addition to this, the second through hole HT, through which light reflected by the reflector D3 is irradiated in front of the vehicle (lower side in FIGS. 2 and 3), is arranged between the reflectors G1 and G2. In this configuration, the light emitted from the light source A to the reflector D3 is reflected by the reflector D3, and passes through the second through hole HT between the reflectors G1 and G2, and then is irradiated in front of the vehicle (lower side in FIGS. 2 and 3). In this manner, the vehicle headlight can improve the light utilization efficiency of the light source A with high intensity light distribution.

Light passing through the second through hole HT can be incident on the diffusion plate F and refracted. Then, the refracted light is diffused by the diffusion plate F in the right and left directions to be irradiated to the right front area (lower left side in FIG. 3) and right area (left side in FIG. 3) of the vehicle. Also, the light reflected by the diffusion plate F can be irradiated to the left front of the vehicle (lower right in FIG. 3). Namely, in the above-described exemplary embodiment, not only is the refracted light transmitted through the diffusion plate F irradiated to the front of the vehicle (lower side in FIG. 3), but the light reflected by the diffusion plate F is also irradiated in front of the vehicle, thereby effectively utilizing the light of the light source A. The vehicle headlight in accordance with the above-described exemplary embodiment can improve the light utilization efficiency. More specifically, the light utilization ration can be increased from approximately 85% to approximately 95%.

In the above-described exemplary embodiment, the vehicle headlight can include a diffusion plate F. However, the disclosed subject matter is not limited thereto. As another exemplary embodiment, principles of the disclosed subject matter can be applied to a vehicle headlight without any diffusion plate. The vehicle headlight of the exemplary embodiment of FIGS. 2 and 3 can include the diffusion plate F made of a transparent corrugated plate. Again, the disclosed subject matter is not limited thereto. Instead, a diffusion plate made of a translucent plate or a colored transparent plate which can provide a certain transmittance can be included.

In the exemplary embodiment of FIGS. 2 and 3, the convex portions are provided in the emitting surface of the diffusion plate F (left side in FIG. 3). However, the disclosed subject matter is not limited thereto. In another exemplary embodiment, convex portions can be provided in the incident surface (right side in FIG. 3) or both the surfaces of the diffusion plate F. Alternatively, concave portions can be provided in one or both of the surfaces of the diffusion plate F (instead of providing the convex portions).

In the exemplary embodiment of FIGS. 2 and 3, the diffusion plate F and the reflector G1 are formed as a single unit. Accordingly, the number of parts can be reduced in comparison with the case where they are separately formed, thereby reducing manufacturing cost. The disclosed subject matter, however, is not limited thereto. Specifically, for particular application the diffusion plate F and reflector G1 may be separately formed.

Figure 8:
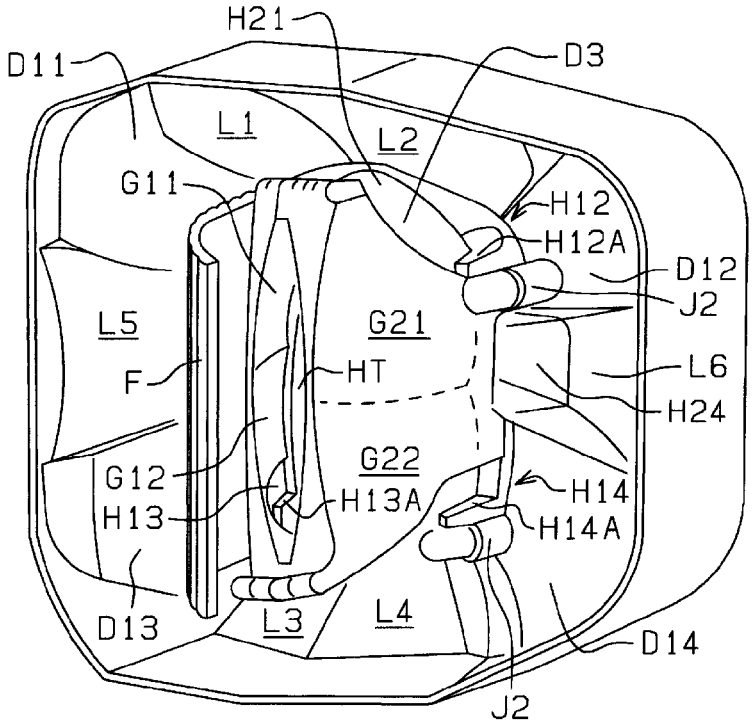
FIG. 8 is a perspective view of yet another embodiment of a vehicle headlight made in accordance with principles of the presently disclosed subject matter.

A description will now be given of the vehicle headlight according to yet another exemplary embodiment as shown in FIG. 8. FIG. 8 shows a perspective view of a vehicle headlight. In particular, FIG. 8 is a view when a vehicle headlight that is configured for mounting on the right side of the vehicle body is seen from front and above. The vehicle headlight in accordance with the exemplary embodiment of FIG. 8 has a similar configuration to the first exemplary embodiment except for the following points. Thus, the same or similar effects can be attained in this embodiment as compared to the embodiment of FIGS. 2 and 3.

In FIG. 8, the same reference symbols and numerals as those in FIGS. 2 and 3 denote the same or similar parts or portions as shown in FIGS. 2 and 3.

In FIG. 2, the reflector G1 is configured as a single part. In contrast, the vehicle headlight in accordance with the exemplary embodiment as shown in FIG. 8 has reflectors G11 and G12 vertically separated as two parts instead of the single reflector G1. Similarly, in FIG. 2, the reflector G2 is configured as a single part. The disclosed subject matter, however, is not limited thereto. The vehicle headlight in accordance with the exemplary embodiment as shown in FIG. 8 has reflectors G21 and G22 vertically separated as two parts instead of the single reflector G2.

In the exemplary embodiment as shown in FIG. 8, light reflected by the elliptic reflector G21 is allowed to pass through a hole H11 (not shown) which is formed in the boundary portion between the reflectors D3 and G11. Then, the light is reflected by the reflector D11 to be irradiated in front of the vehicle. In addition to this, the light reflected by the elliptic reflector G11 is allowed to pass through a hole H12 which is formed in the boundary portion between the reflectors D3 and G21. Then, the light is reflected by the reflector D12 and irradiated in front of the vehicle. In addition to this, the light reflected by the elliptic reflector G22 is allowed to pass through a hole H13 which is formed in the boundary portion between the reflectors D3 and G12. Then, the light is reflected by the reflector D13 and irradiated in front of the vehicle. Furthermore, the light reflected by the elliptic reflector G12 is allowed to pass through a hole H14 which is formed in the boundary portion between the reflectors D3 and G22. Then, the light is reflected by the reflector D14 and irradiated in front of the vehicle.

In the exemplary embodiment as shown in FIG. 8, the lower edge H11A (not shown) of the hole H11 (not shown) for providing a cut-off line in the light distribution pattern formed in front of the vehicle by the reflector D11 is not provided in the reflector G11 , but in the reflector D3. Furthermore, the lower edge H12A of the hole H12 for providing a cut-off line in the light distribution pattern formed in front of the vehicle by the reflector D12 is not provided in the reflector G21, but in the reflector D3. Furthermore, the lower edge H13A of the hole H13 for providing a cut-off line in the light distribution pattern formed in front of the vehicle by the reflector D13 is not provided in the reflector G12, but in the reflector D3. In addition, the lower edge H14A of the hole H14 for providing a cut-off line in the light distribution pattern formed in front of the vehicle by the reflector D14 is not provided in the reflector G22, but in the reflector D3.

In the exemplary embodiment as shown in FIG. 8, part of light emitted from the light source A (not shown) is allowed to pass through the hole 21 formed in the boundary portion between the reflectors G11 and G21. Then, the light is irradiated in the right front direction by the reflector L1 and in the left front direction by the reflector L2. In addition to this, part of light emitted from the light source A (not shown) is allowed to pass through the hole H22 (not shown) formed in the boundary portion between the reflectors G12 and G22. Then, the light is irradiated in the right front direction by the reflector L3 and in the left front direction by the reflector L4. Furthermore, part of light emitted from the light source A (not shown) is allowed to pass through the hole H23 (not shown) formed in the boundary portion between the reflectors G11 and G12. Then, the light is irradiated in the forward direction by the reflector L5. In addition to this, part of light emitted from the light source A (not shown) is allowed to pass through the hole H24 formed in the boundary portion between the reflectors G21 and G22. Then, the light is irradiated in the forward direction by the reflector L6.

Light which is reflected once by the reflector L1, L2, L3, L4, L5, or L6 is irradiated in the forward direction, thereby reducing loss of light due to multiple reflections.

While there has been described what are at present considered to be exemplary embodiments of the invention, it will be understood that various modifications may be made thereto, and it is intended that the appended claims cover such modifications as fall within the true spirit and scope of the invention.

What is claimed is:

1. A vehicle light having an emitting direction comprising:

a light source;

a first reflector configured to reflect light emitted from the light source;

a second reflector configured to reflect light reflected by the first reflector along the emitting direction of the vehicle light; and a support member configured to support the light source, the support member being separately formed from the first reflector, wherein the support member includes an edge portion that is configured to form a cut-off line in a light distribution pattern that is irradiated by the second reflector towards a position located along the emitting direction of the vehicle light, the vehicle light is configured for mounting to a vehicle and includes, a center-side that is configured to be closer than the light source is to a center of the vehicle when the vehicle light is mounted to the vehicle, and a side-face side that is configured to be further than the light source is from the center of the vehicle when the vehicle light is mounted to the vehicle, the first reflector includes a first center-side reflector which is disposed on the center-side of the vehicle light, and a first side-face reflector which is disposed on the side-face side of the vehicle light;

the first center-side reflector has a first focus and the light source is disposed substantially at the first focus, and the first side-face reflector has a primary focus and the light source is disposed substantially at the primary focus;

the second reflector includes a second center-side reflector which is disposed on the center-side of the vehicle light, and a second side-face reflector which is disposed on the side-face side of the vehicle light; and an average distance from a second focus of the first center-side reflector to a reflecting surface of the second side-face reflector is substantially 1.5 to 2 times as long as an average distance from a second focus of the first side-face reflector to a reflecting surface of the second center-side reflector.

2. The vehicle light according to 1, wherein the support member having the edge portion and the second reflector are integrally formed as a single unit.

3. The vehicle light according to claim 1, wherein an area of the reflecting surface of the second side-face reflector is substantially two to three times as large as an area of the reflecting surface of the second center-side reflector.

4. The vehicle light according to claim 3, wherein a light converging power of the second side-face reflector is larger than a light converging power of the second center-side reflector.

5. The vehicle light according to claim 1, wherein:

the light source is configured such that a central axis of the light source is approximately parallel to a horizontally cross-sectional curve taken along the first center-side reflector; and a first through hole is formed in the horizontally cross-sectional curve taken along the first center-side reflector so that the light emitted from the light source is allowed to pass through the first through hole.

6. The vehicle light according to claim 1, wherein:

the support member includes a reflecting surface configured to reflect light emitted from the light source; and a second though hole is disposed between the first center-side reflector and the first side-face reflector so that the second though hole permits light reflected from the reflecting surface of the support member to be irradiated in the emitting direction of the vehicle light.

7. The vehicle light according to claim 6, further comprising:

a diffusion plate having a predetermined transparency and being configured to horizontally diffuse light passing through the second though hole, wherein the diffusion plate extends from a position adjacent the second through hole on the side-face side of the vehicle light towards the emitting direction of the vehicle light and the diffusion plate is curved toward the center-side of the vehicle light.

8. The vehicle light according to claim 7, wherein the diffusion plate is configured such that a part of the light passing though the second though hole passes through the diffusion plate to generate diffracted light which is in turn horizontally diffused and irradiated in front of the vehicle light, the diffusion plate also being configured such that another part of the light passing through the second though hole is reflected by the diffusion plate and irradiated in front of the vehicle light.

9. The vehicle light according to claim 7, wherein the diffusion plate and the first side-face reflector are integrally formed as a single unit.

10. The vehicle light according to claim 8, wherein the diffusion plate and the first side-face reflector are integrally formed as a single unit.

11. The vehicle light according to claim 3, wherein:

the light source is configured such that a central axis of the light source is approximately parallel to a horizontally cross-sectional curve taken along the first center-side reflector; and a first through hole is formed in the horizontally cross-sectional curve taken along the first center-side reflector so that the light emitted from the light source is allowed to pass through the first through hole.

12. The vehicle light according to claim 4, wherein:

the light source is configured such that a central axis of the light source is approximately parallel to a horizontally cross-sectional curve taken along the first center-side reflector; and a first through hole is formed in the horizontally cross-sectional curve taken along the first center-side reflector so that the light emitted from the light source is allowed to pass through the first through hole.

13. The vehicle light according to claim 3, wherein:

the support member includes a reflecting surface configured to reflect light emitted from the light source; and a second through hole is disposed between the first center-side reflector and the first side-face reflector so that the second though hole permits light reflected from the reflecting surface of the support member to be irradiated in the emitting direction of the vehicle light.

14. The vehicle light according to claim 4, wherein:

the support member includes a reflecting surface configured to reflect light emitted from the light source; and a second through hole is disposed between the first center-side reflector and the first side-face reflector so that the second through hole permits light reflected from the reflecting surface of the support member to be irradiated in the emitting direction of the vehicle light.

15. The vehicle light according to claim 5, wherein:

the support member includes a reflecting surface configured to reflect light emitted from the light source; and a second through hole is disposed between the first center-side reflector and the first side-face reflector so that the second through hole permits light reflected from the reflecting surface of the support member to be irradiated in the emitting direction of the vehicle light.

* * * * *

UNITED STATES PATENT AND TRADEMARK OFFICE

CERTIFICATE OF CORRECTION

PATENT NO. : 7,484,868 B2
APPLICATION NO. : 11/567881
DATED : February 3, 2009
INVENTOR(S) : Hiroo Oyama It is certified that error appears in the above-identified patent and that said Letters Patent is hereby corrected as shown below:

Claims 2, 6, 7, 8, and 13 should be corrected as follows:

Column 16, lines 23-25, claim 2 should read
2. The vehicle light according to claim 1, wherein the support member having the edge portion and the second reflector are integrally formed as a single unit.
Column 16, lines 44-51, claim 6 should read
6. The vehicle light according to claim 1, wherein:
the support member includes a reflecting surface configured to reflect light emitted from the light source; and
a second through hole is disposed between the first center-side reflector and the first side-face reflector so that the second through hole permits light reflected from the reflecting surface of the support member to be irradiated in the emitting direction of the vehicle light.
Column 16, lines 52-61, claim 7 should read
7. The vehicle light according to claim 6, further comprising:
a diffusion plate having a predetermined transparency and being configured to horizontally diffuse light passing through the second through hole, wherein
the diffusion plate extends from a position adjacent the second through hole on the side-face side of the vehicle light towards the emitting direction of the vehicle light and the diffusion plate is curved toward the center-side of the vehicle light.
Column 16, line 62 – Column 17, line 3 claim 8 should read
8. The vehicle light according to claim 7, wherein the diffusion plate is configured such that a part of the light passing through the second through hole passes through the diffusion plate to generate diffracted light which is in turn horizontally diffused and irradiated in front of the vehicle light, the diffusion plate also being configured such that another part of the light passing through the second through hole is reflected by the diffusion plate and irradiated in front of the vehicle light.
Column 18, lines 1-8, claim 13 should read
13. The vehicle light according to claim 3, wherein:
the support member includes a reflecting surface configured to reflect light emitted from the light source; and a second through hole is disposed between the first center-side reflector and the first side-face reflector so that the second through hole permits light reflected from the reflecting surface of the support member to be irradiated in the emitting direction of the vehicle light.

Signed and Sealed this

Sixteenth Day of February, 2010

David J. Kappos

David J. Kappos
*Director of the United States Patent and Trademark Office*